United States Patent [19]

Moore

[11] Patent Number: 4,602,598

[45] Date of Patent: Jul. 29, 1986

[54] SPRING AND VALVE SKIRT

[76] Inventor: Locke Moore, 1205 Platinum Ave., Raleigh, N.C. 27610

[21] Appl. No.: 755,226

[22] Filed: Jul. 15, 1985

Related U.S. Application Data

[63] Continuation of Ser. No. 460,296, Jan. 24, 1983, abandoned.

[51] Int. Cl.[4] ..... F01L 3/10

[52] U.S. Cl. ..... 123/90.67; 123/188 P

[58] Field of Search ..... 123/90.65, 90.67, 188 AA, 123/188 AF, 188 SB, 188 SA, 188 GC, 188 VS, 188 P

[56] References Cited

U.S. PATENT DOCUMENTS

| | | | |
|---|---|---|---|
| 2,396,347 | 3/1946 | Sanders | 123/188 GC |
| 3,096,750 | 7/1963 | Bouvy et al. | 123/90.67 |
| 3,114,361 | 12/1963 | Mullen | 123/188 P |
| 3,742,712 | 7/1973 | Garcea | 123/188 GC |
| 3,853,101 | 12/1974 | Iskenderian et al. | 123/90.67 |
| 4,201,162 | 5/1980 | Speckhart | 123/188 SB |
| 4,380,216 | 4/1983 | Kandler | 123/90.65 |

FOREIGN PATENT DOCUMENTS

| | | | |
|---|---|---|---|
| 428417 | 12/1947 | Italy | 123/188 P |

OTHER PUBLICATIONS

Wise, C. E. "Plastic Engine is Off and Running," *Machine Design,* vol. 52, (May 8, 1980), pp. 24–26.

"The Future is Now with Torlon Engine Parts" Amoco Chemicals Corporation Bulletin TAT-29, pub. Jun. 1982.

*Primary Examiner*—Craig R. Feinberg
*Assistant Examiner*—David A. Okonsky
*Attorney, Agent, or Firm*—Mills and Coats

[57] ABSTRACT

This invention is a spring and valve skirt which can be retrofitted to existing engines as well as installed on new ones. This skirt slips over the valve stem and valve spring of an engine and in addition to other advantages greatly reduces exhaust emissions.

8 Claims, 4 Drawing Figures

SPRING AND VALVE SKIRT

This application is a continuation, of application Ser. No. 460,296, filed 01/24/83 and now abandoned.

FIELD OF INVENTION

This invention relates to propulsion systems and more particularly to devices for improving the functioning of internal combustion engines.

BACKGROUND OF INVENTION

Since man first began to experiment with internal combustion engines, the problem of excessive oil consumption and the associated particulate exhaust emissions have been a problem. The present environmental concerns and economic conditions present a unique problem in that excessive particulate engine exhaust emissions are undesirable for environmental purposes and yet the expenditures normally required to reduce such emissions in many instances cannot be justified, particularly in older, high mileage vehicles.

BRIEF DESCRIPTION OF INVENTION

After much research and study into the above-mentioned problems, the present invention has been developed to provide a means for substantially reducing the particulates in engine exhaust without the expenditure of large sums of money to accomplish the same. This result has been achieved through providing a cup-like skirt which is disposed over the valve stem and its associated valve spring. This not only prevents excessive engine lubricating oil from seeping down the valve guide into the combustion area of the engine which, if allowed, causes rings to stick due to burned oil carbon deposits, causes spark plug misfire and greatly increases particulate emission in the engine exhaust, but it also prevents misalignment of the valve spring, reduces excessive wear on rocker arm and valve stem, and maintains the push rod, rocker arm and valve stem in proper alignment.

In view of the above, it is an object of the present invention to provide a simple and inexpensive means for substantially reducing particulate emissions in the exhaust of internal combustion engines.

Another object of the present invention is to provide a means for reducing exhaust emissions while at the same time assuring proper alignment of valve stems and their associated rocker arms and push rods.

Another object of the present invention is to provide a simple, inexpensive and yet highly efficient means for increasing engine perfomance while at the same time reducing exhaust emissions.

Another object of the present invention is to provide a means for substantially reducing oil seepage down valve guides into the combustion area of an internal combustion engine.

Another object of the present invention is to provide a means for preventing stuck rings due to oil burned carbon deposits wedging in the ring grooves.

Another object of the present invention is to provide a means for preventing spark plug misfire and fouling in an oil burning engine by substantially reducing oil seepage through the valve guides by the installation of an inexpensive and yet highly efficient valve stem and spring skirt means.

Other objects and advantages of the present invention will become apparent from a study of the following description and the accompanying drawings which are merely illustrative of such invention.

DETAILED DESCRIPTION OF INVENTION

With further reference to the drawings, the cup-like skirt of the present invention, indicated generally at 10, includes a generally cylindrical shaped side wall portion 11 and a slightly elevated end portion 12.

Figure 2:
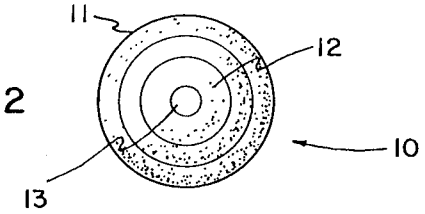
FIG. 2 is a top plan view of such skirt.
Figure 3:
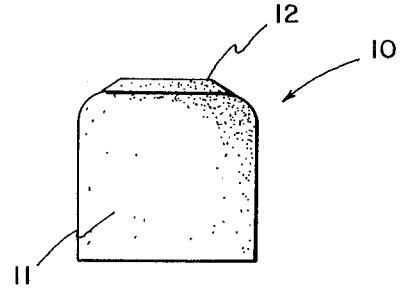
FIG. 3 is a side elevational view thereof.
Figure 4:
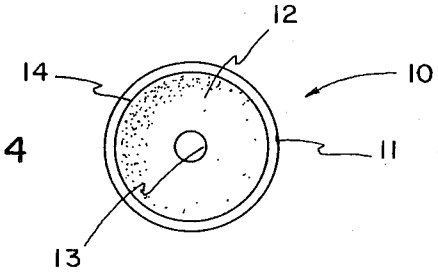
FIG. 4 is a bottom plan view thereof.
Figure 1:
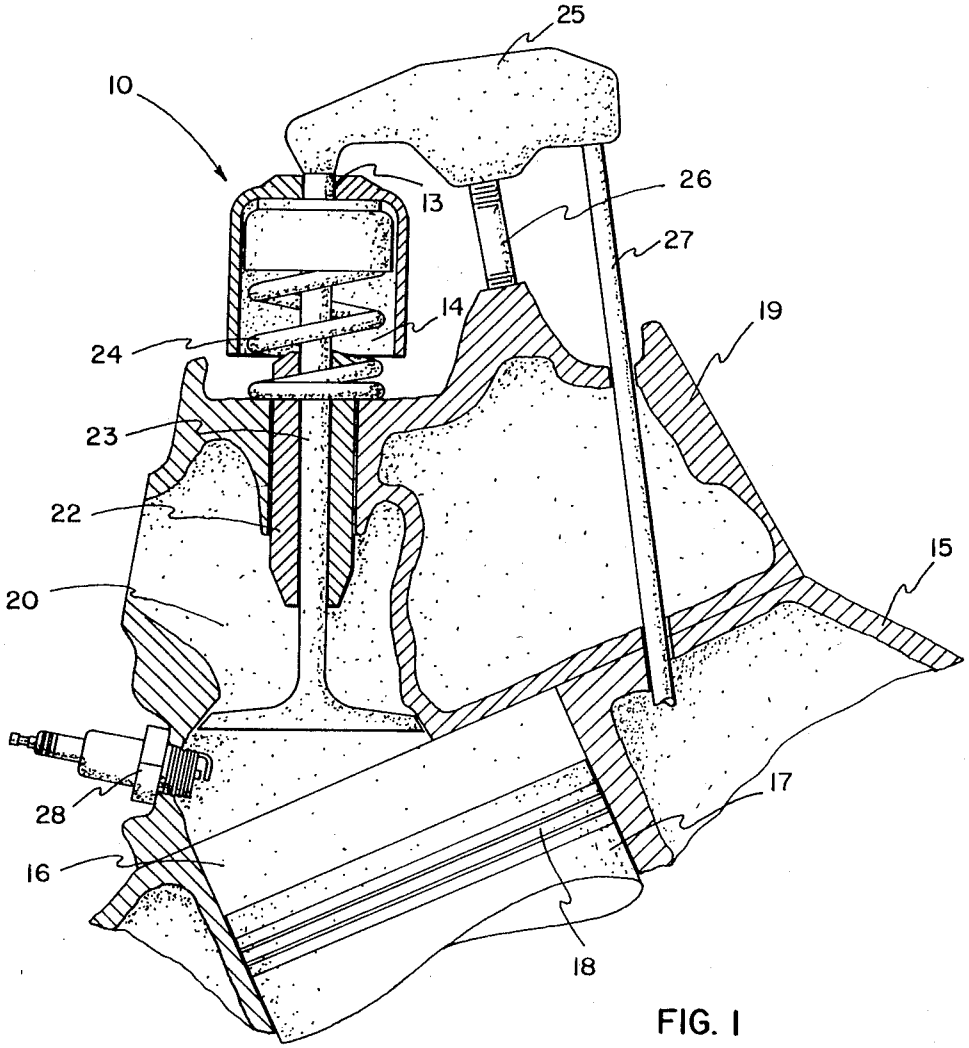
FIG. 1 is a sectional view taken through a typical internal combustion engine showing the spring and valve skirt of the present invention in use.

A relatively small axial opening 13 is provided in the center of end portion 12 which communicates to the interior 14 of skirt 10 as can clearly be seen in FIG. 1.

The skirt 10 of the present invention is preferably formed as an integral unit from mylar, or other suitable heat resistant, warpage resistant plastic or other material. This, of course, does not eliminate the possibility of the present invention from being formed from aluminum or other medals or alloys or from other materials which may in the future be developed.

For illustrative purposes, a typical engine overhead valve is shown in FIG. 1. This includes an engine block 15 with its combustion area 16 and associated piston 17 carrying piston rings 18.

The engine head is indicated at 19 and includes the normal intake or exhaust area 20 with the valve 21 acting as a closure between the intake/exhaust area 20 and the combustion area 16. A valve guide 22 is provided in the normal manner with valve stem 23 slidably passing therethrough.

The normal valve spring 24 is provided about the upper portion of valve guide 22 and valve stem 23 and biases valve 21 to the closed position, again as shown clearly in FIG. 1.

The normal rocker arm 25 is operatively mounted on rocker arm stud 26 with one end engaging valve stem 23 and the other end engaging push rod 27.

The above described is a typical valve installation commonly found on a multitude of different types and styles of engines. When the valve guides 22 become worn, oil can seep down between such guides and their associated valve stems 23 so that as the valves 21 open, oil will be sucked into the combustion area 16 in the intake or will be blown out with the exhaust gases. In the former case the oil will be burned creating carbon buildup causing the piston rings 18 to stick and the spark plugs 28 to foul and misfire.

To either prevent the above-desired situation from developing or to correct the same once it has developed, the skirt of the present invention is installed over the valve spring 24 and valve stem 23 with such stem projecting through axial opening 13 in the end thereof. As the valve stem moves up and down compressing and releasing valve spring 24 through the interaction of push rod 27, the area between valve guide 22 and valve stem 23 will be protected thus greatly reducing the amount of lubricating oil which is exposed to such area.

From FIG. 1 it can be seen that the bottom of skirt 10 is approximately even with or slightly covers the upper or outer end of valve guide 22 to effectuate the reduction of lubricant which might otherwise become burned and yet there is enough of an opening between said skirt and said guide end so that adequate lubrication can reach valve stem 23 for lubrication purposes. Thus it can be seen that valve lubrication occurs while excessive lubrication which causes undesirable carbon build-ups, sticking rings, fouled spark plugs and high particulate emissions in exhaust gases are prevented.

From actual tests, a 1976 Plymouth Fury which was considered an "oil burner" had a total particulate exhaust emission of 192.1 mg/mi without installation of the skirts of the present invention. This emission was reduced by 71% by installation of the spring and valve skirts 10 of the present invention.

In addition to preventing oil from seeping down valve guides into the combustion areas with the resultant problems enumerated above, the skirts prevent the valve springs from bouring out of alignment and losing strength thus causing poor engine performance, prevent the rocker arms from wearing the valve stem heads sideways, prevent the rocker arms from cutting the rocker studs as well as prevent push rod and gall ball side wear.

From the above it can be seen that the present invention provides a highly efficient and yet inexpensive means for reducing engine wear and exhaust emissions as well as preventing carbon build-up problems.

This invention can be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. In an engine having a valve guide operatively mounting a valve stem and its associated valve spring and spring retainer for actuation of the valve stem by a valve actuator, the improvement comprising: a hollow, generally cylindrical shaped skirt means having a side portion forming an interior with one open end and having at its other end an end portion extending inwardly and formed with an axial opening therein communicating to said interior, said skirt means being mounted on and about said valve stem and spring retainer and about its spring so as to move with the valve stem and to cover said spring retainer and most of the portion of said valve spring and said valve stem extending outwardly from said valve guide except for an outermost end of said stem which extends through said opening in said end portion for actuation by said actuator, such that said inwardly extending end portion lies between said outermost end of said stem and an outermost end of said spring retainer to allow for retrofitting insertion of the skirt means over existing valve stems without removal of the spring and spring retainer, whereby excessive oil is prevented from seeping between said valve guide and said valve stem thus preventing excessive carbon build-up in the combustion area, sticking valves, fouled plugs and high exhaust emissions.

2. The means of claim 1 wherein the end portion of said skirt having the axial opening therein is of a thickess approximately double the thickness of the side portion whereby an improved valve skirt is provided.

3. The means of claim 1 wherein said skirt means is constructed from a plastic type material.

4. The means of claim 3 wherein said plastic material is mylar.

5. The means of claim 1 wherein said skirt means is formed from a metallic material.

6. The means of claim 5 wherein said metallic material is an aluminum alloy.

7. The method of reducing oil consumption and associated undesirable exhaust emissions in an internal combustion engine having at least one valve stem mounted in a valve guide with an associated rocker arm, valve spring retainer and valve spring comprising: producing a generally cup-shaped skirt means having a generally cylindrical side portion open at one end and having at its opposite end an inwardly extending portion having an axial opening therein thereby forming an end portion; exposing an outer end of said valve stem to provide mounting clearance thereabout for said skirt means; mounting said skirt means over said valve spring, valve spring retainer and said valve stem with said end portion adjacent said rocker arm and with said valve stem projecting through said axial opening for actuation by said rocker arm such that said end portion is disposed between outermost ends of said stem and said spring retainer and the skirt means moves with the valve stem, an edge of said side portion opposite said end portion having the axial opening therein being disposed generally in a lateral plane approximately even with one end of said valve guide; and operating said engine with said skirt means so mounted whereby excessive oil is prevented from seeping betwen said valve stem and said valve guide thereby preventing carbon build-up in the combustion area, sticking valves, fouled plugs and excessive exhaust emissions.

8. The method of claim 7 wherein the thickness of the end portion having the axial opening therein is approximately double the thickness of side portion of said skirt.

* * * * *